US006057804A

United States Patent [19]

Kaegebein

[11] Patent Number: 6,057,804

[45] Date of Patent: May 2, 2000

[54] PARALLEL FED COLLINEAR ANTENNA ARRAY

[75] Inventor: Daniel P. Kaegebein, Depew, N.Y.

[73] Assignee: TX RX Systems Inc., Angola, N.Y.

[21] Appl. No.: 08/948,403

[22] Filed: Oct. 10, 1997

[51] Int. Cl.[7] ..... H01Q 9/16

[52] U.S. Cl. ..... 343/792; 343/790; 343/891

[58] Field of Search ..... 333/127, 128; 343/790, 791, 792, 891

[56] References Cited

U.S. PATENT DOCUMENTS

| | | | |
|---|---|---|---|
| 3,899,787 | 8/1975 | Czerwinski | 343/790 |
| 4,369,449 | 1/1983 | MacDougall | 343/790 |
| 4,578,652 | 3/1986 | Sterns | 333/117 |
| 4,875,024 | 10/1989 | Roberts | 333/127 |
| 5,621,420 | 4/1997 | Benson | 343/791 |
| 5,798,736 | 8/1998 | Hall | 343/791 |

OTHER PUBLICATIONS

Mobile Antenna Systems Handbook, Editors—K. Fujimoto & J.R. James, pp. 152–159.

*Primary Examiner*—Don Wong
*Assistant Examiner*—Hoang Nguyen
*Attorney, Agent, or Firm*—Simpson, Simpson & Snyder

[57] ABSTRACT

A coaxial dipole antenna element which has omni-directional radiation characteristics in azimuth and can be incorporated into linear antenna arrays to shape the radiation pattern in the vertical dimension is fed by coaxial conductors built into a electrically integral center support extrusion.

20 Claims, 7 Drawing Sheets

PARALLEL FED COLLINEAR ANTENNA ARRAY

FIELD OF THE INVENTION

This invention relates to a collinear antenna array consisting of vertically stacked dipoles which are parallel fed for improved bandwidth while maintaining a uniform circular radiation pattern in the azimuth and consistent beamwidth characteristics in the vertical dimension. The antenna is a compact assembly, and protected from the environment by a fiberglass radome. This antenna design is useful in the frequency range of 100 Mhz to over 1000 Mhz.

BACKGROUND OF THE INVENTION

Collinear array dipole antennas are well known for providing omnidirectional radiation. The prior art includes antennas such as the Franklin antenna, schematically illustrated in FIG. 1, the series-fed transposed coaxial collinear antenna of FIG. 2, and the series-fed symmetrical coaxial collinear antenna shown in FIG. 3. Current distribution along the array is graphically depicted for each antenna. These antennas inherently possess a narrow bandwidth. This is because the radiating elements are series fed, resulting in varying transmission phase lengths from the array feed point to the various dipoles of the array. A dipole array which is parallel fed, having equal transmission line feeds from the common array feed point to each dipole, will undergo a similar phase shift to each dipole as frequency is varied. The result is a more uniform radiation pattern over its bandwidth. A common method of feeding stacked dipole antennas in parallel is to side mount dipoles off a central support structure, spacing them symmetrically around and close to the mast at 90 degree increments as shown in FIG. 4. This is to minimize the deviation from circularity in the azimuth of each dipole. The support mast actually is a parasitic element in this configuration, and results in a cardiod pattern for each dipole location. The "phase center" of the dipole/mast structure is located along a line between the mast and the dipole, and hence, the phase centers of the various dipole antenna locations are not axially aligned, or collinear. This results in a pattern that deviates from circularity by typically +/−1.5 dB for a nominal 6 dB gain antenna. In addition, the center of the main lobe will deviate above and below the horizon to some degree, as one views the pattern from various sectors in the azimuth.

As a result of the preceding problems, with rare exceptions, elemental center-fed dipole antennas are not used in vertical polarization applications due to mounting and feeding effects on symmetry. The symmetry problem is partially alleviated through the use of series fed symmetrical coaxial collinear antenna arrays such as illustrated in FIG. 3. Such arrays are comprised of coaxial center fed halfwave dipole elements with a choke as illustrated in FIGS. 5A, B and C where an antenna is illustrated structurally and schemati-cally. However, such arrays suffer the same disadvantage as all other known vertical arrays of dipole antenna elements in that they require a precise relationship between radiator element spacing and radiator element length, resulting in a narrow bandwidth which precludes their use in broad band applications.

OBJECTIVES OF THE INVENTION

It is a primary objective of the present invention to provide an antenna element which has a uniform, omnidirectional radiation pattern in azimuth.

A further primary objective of the present invention is to provide a vertically polarized array of dipole antenna elements exhibiting a symmetrical omni-directional radiation pattern.

A still further primary objective of the invention is to provide a vertically polarized array of dipole radiating elements wherein the spacing between radiating elements is not dictated by radiating element length to thereby allow broad band applications.

Another objective is to provide an omnidirectional coaxial dipole antenna and an electrically integral mast which is coaxially fed and vertically stacked to provide a collinear array.

Another objective of the present invention is to provide a collinear antenna array comprised of coaxial dipole antenna elements supported by a electrically integral, rigid, self-supporting mast comprised of a plurality of coaxial transmission elements feeding the antenna radiating elements.

A still further objective of the invention is to provide a vertically stacked collinear antenna array comprised of coaxial dipole antenna elements fed by power dividers which cooperate with the electrically integral antenna mast structure which forms parallel coaxial transmission lines.

A still further objective of the invention is to provide a coaxial dipole antenna element with a coaxial feed built into an electrically integral center support extrusion where up to five coaxial center conductors can be installed to form the corporate feed structure to up to 16 elements.

SUMMARY OF THE INVENTION

The present invention overcomes the foregoing drawbacks, and produces an array of dipoles which have the phase centers axially aligned, and which alignment is also coincident with the mechanical structure of the dipoles.

A coaxial center-fed dipole, or sleeve antenna, evolves into a series-fed symmetrical coaxial collinear antenna for stacking coaxial dipoles of increased gain in the azimuth. This structure inherently allows only one transmission feed line to pass through the center of the dipole array, all dipoles being series fed from this common transmission line, resulting in a narrow bandwidth compared to a parallel fed antenna.

The present discussion will revolve around the embodiment for the 800 to 960 Mhz band, however, the principles will apply to all frequencies where the structure is physically realizable.

It was necessary to find a means to allow multiple transmission lines to pass up through the structure of the center-fed coaxial dipole without disrupting its operation. This was done by employing the coaxial dipole construction of FIG. 7.

The usual single coaxial transmission line structure is replaced with a single aluminum extrusion which contains five coaxial transmission bores in a circular configuration, and with a narrow longitudinal slot along each transmission line, opening to the outer circumference. This extrusion acts as the central antenna support, and for each dipole, the inner conductor of two chokes, formed in conjunction with the smaller cylinder of the dipole, being nominally ½ wavelength and shorted to the central extrusion at its midpoint via five connecting aluminum rods. The five rods are a skeletal substitute for a solid grounding ring. The narrow slot in each transmission line allows access to outer coaxial elements anywhere along its length.

To form the halfwave dipole, a second skeletal ring is constructed at one end of the ½ wavelength cylinder to support a larger ¼ wavelength cylinder over about one half the length of the ½ wavelength cylinder. This provides a method of supporting and electrically isolating the driven quarterwave of the dipole from the quarterwave, formed by the remaining half of the smaller cylinder, and connected to the outer conductor of the coaxial transmission line, or, in this case, the "bundled" transmission line bores formed by the central extrusion.

The exposed quarterwave of the smaller cylinder has a slot which is also a quarterwave long, and oriented to be above the slot of one of the transmission bores. This allows the center conductor of the transmission line to make a connection to the larger cylinder at approximately the midpoint of the dipole assembly. The slot has no noticeable effect on the performance, as it runs parallel to the resonant currents. The slot also aids in assembly of the elements.

The present embodiment uses 2.5" and 3.0" diameter cylinders, and the central extrusion is nominally 1.562" in diameter. The cylinder walls are 0.049" and 0.065" thick respectively. Each of the five transmission line bores is 0.431" in diameter. Compensating for some loss of capacitance due to the slot, using a 0.187" diameter center conductor will result in a 50 ohm impedance transmission line.

In the 800 to 960 Mhz embodiment, the diameter of these cylinders results in a very broadband dipole, and some reduction in the usual center feed point impedance of 72 to 73 ohms for a halfwave dipole. The present embodiment actually measures about 60 to 66 ohms over 65% of the 800–960 Mhz band. In this band, a small series capacitance feeds the 3" diameter driven element of the dipole, offsetting some of the inductance of the connection between the 50 ohm bore transmission line and the 3" diameter driven element. This results in a VSWR of 1.40:1 maximum over the entire 800–960 Mhz band. This bandwidth is maintained in an array of eight dipoles with a VSWR of <1.5:1. The nominally 50 ohm dipoles are parallel connected to a common feed point using the 50 ohm transmission line bores and seven compact 50 ohm wilkenson power combiner/splitters, the latter the subject of a separate pending patent application, Ser. No. 08/831,923, filed Apr. 2, 1997.

BRIEF DESCRIPTION OF THE DRAWINGS

The nature and mode of operation of the present invention will now be more fully described in the following detailed description taken with the accompanying drawings wherein.

DETAILED DESCRIPTION OF THE PREFERRED EMBODIMENTS

Figure 1:
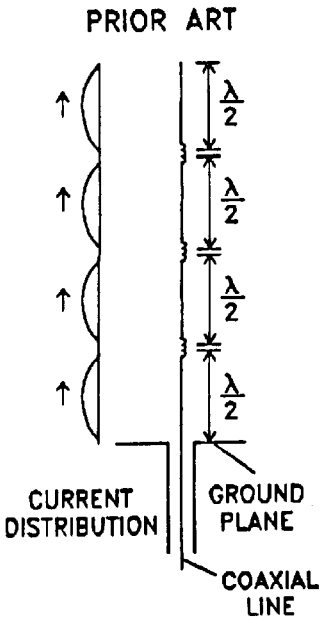
FIG. 1 illustrates a Franklin antenna collinear dipole array and the current distribution exhibited thereby.
Figure 2:
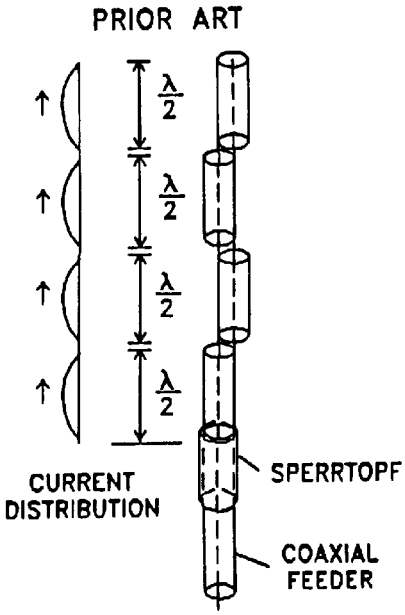
FIG. 2 is a collinear dipole array employing series fed transposed coaxial collinear antenna elements.
Figure 3:
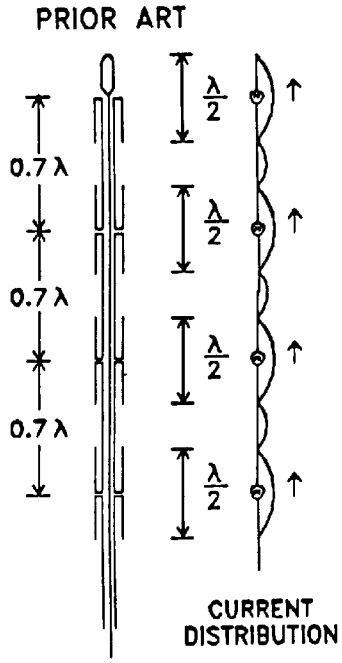
FIG. 3 is a collinear dipole array utilizing series fed symmetrical coaxial collinear antenna elements.
Figure 4:
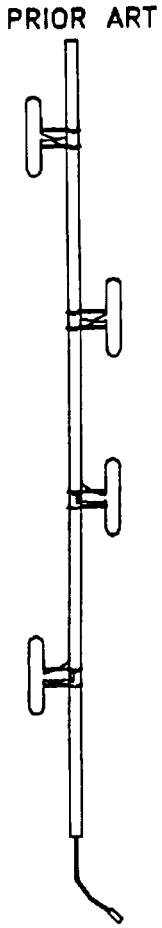
FIG. 4 illustrates a basic array of conventional folded dipoles arranged around a vertical mast.
Figure 5A:
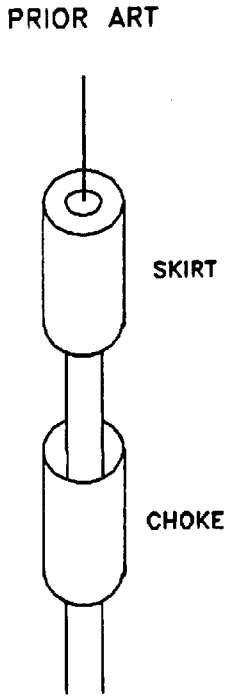
FIG. 5A illustrates a coaxial center fed halfwave dipole with a choke element such as used to create the array illustrated by FIG. 3.
Figure 5B:
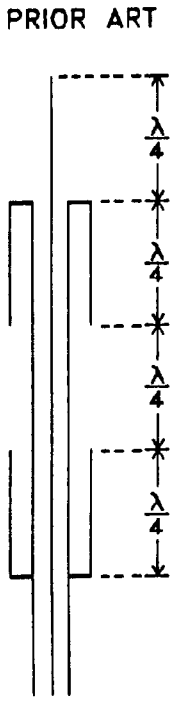
FIG. 5B is a sectional illustration of the FIG. 5A array bisected along the vertical axis.
Figure 5C:
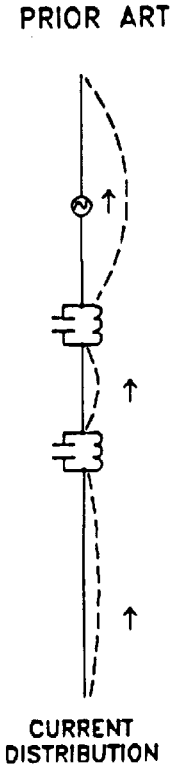
FIG. 5C is a schematic diagram of the coaxial center fed halfwave dipole with a choke element illustrated by FIGS. 5A and 5B.
Figure 6:
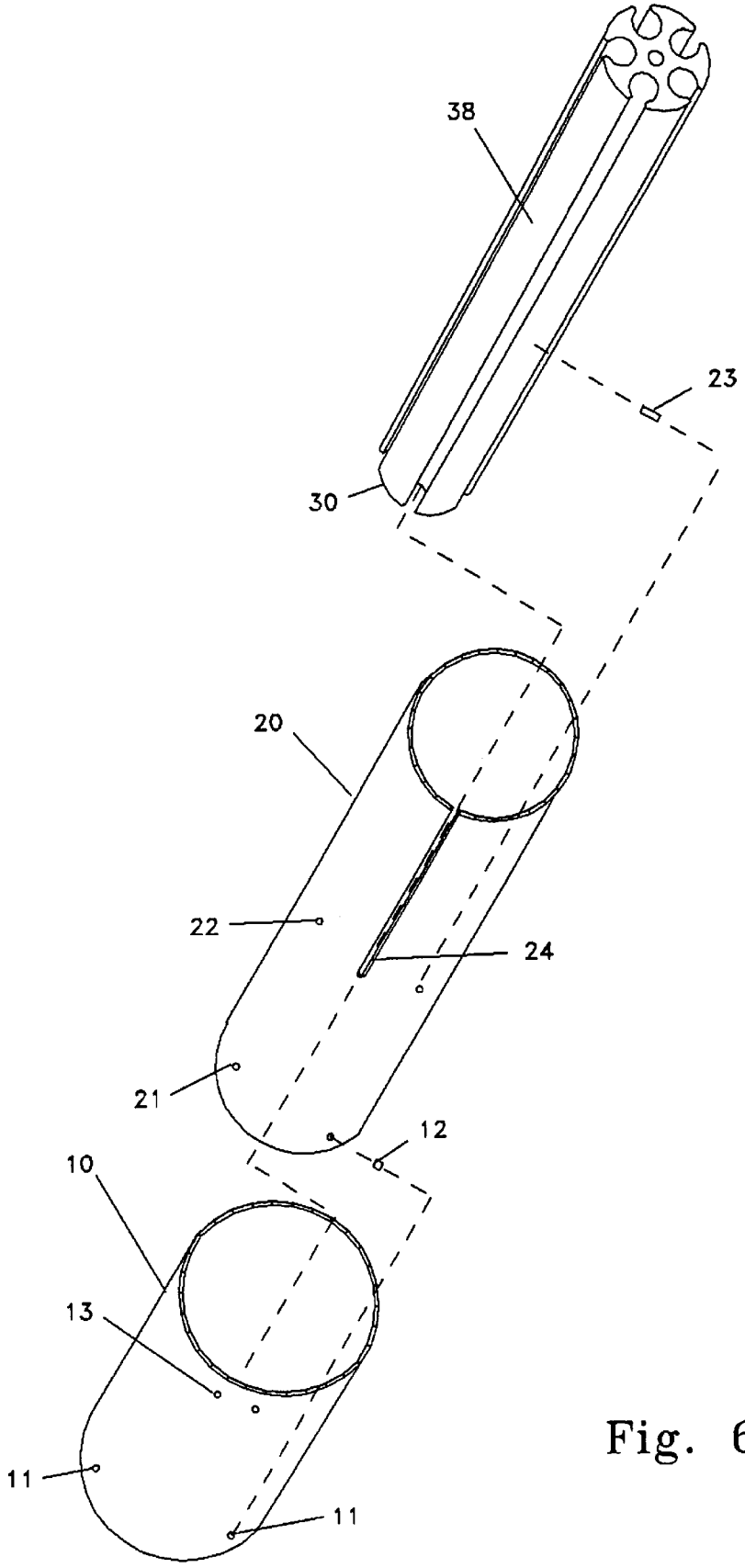
FIG. 6 is an exploded view of the basic elements comprising a coaxial dipole antenna constructed according to the invention.

FIG. 6 is an exploded view of basic components of a coaxial dipole antenna according to the present invention. It is comprised of a pair of coaxial cylinders 10 and 20 coaxially mounted on a conductive electrically integral antenna mast 30. In the preferred and best mode of practicing the invention, the components are fabricated from aluminum. In an exemplary version of the coaxial dipole antenna designed to resonate over the 806 and 960 Mhz band, the radiating cylinder 10 is a 6061-T6 aluminum cylinder having a 3 inch outside diameter and a wall thickness of 0.065 inches. It is provided with a plurality of bores 11 equally spaced around one end. The bores are dimensioned to receive spacer/mounting studs 12. Two additional bores 13 are located near the edge of the other end. They are provided to mount a capacitor board which serves as a means to electrically connect the cylinder to a driving transmission means. The cylinder 10 is one-quarter wavelength long at the operating frequency.

The radiating element 10 is spaced apart from a half-wavelength long cylinder 20 of the same material but having an outside diameter of 2.5 inches and a wall thickness of 0.049 inches. Cylinder 20 is 5.937 inches long and electrically represents a half-wavelength at the operating frequency. It is provided with two sets of bores 21 and 22. Each set is equal in number to the bores 11 of the radiating element 10. The first set of bores 21 of cylinder 20 are equally spaced about one end of the cylinder and angularly positioned so that they are in alignment with the bores 11 of the radiating element 10 when cylinder 20 is coaxially positioned within the radiating element cylinder 10. The spacer/mounting studs 12 have reduced diameter ends to cooperate with bores 11 and 21 so that the radiating element 10 may be retained in coaxial alignment with cylinder 20 by a snap fit process.

The set of bores 22 are arranged in a girdle about the center of cylinder 20 and longitudinally aligned with bores 21. Standoff/mounting studs 23 are provided with a reduced diameter at one end dimensioned to fit within the bores 22. They are slip fit inside the cylinder 20 to provide a standoff/mounting means whereby cylinder 20 may be coaxially positioned over the antenna electrically integral mounting mast 30. The exemplary mast has a surface comprised of 5 arcuate lobes 38 and the bores 22 are positioned and numbered such that one of each set is centrally located over each lobe 38.

Figure 10:
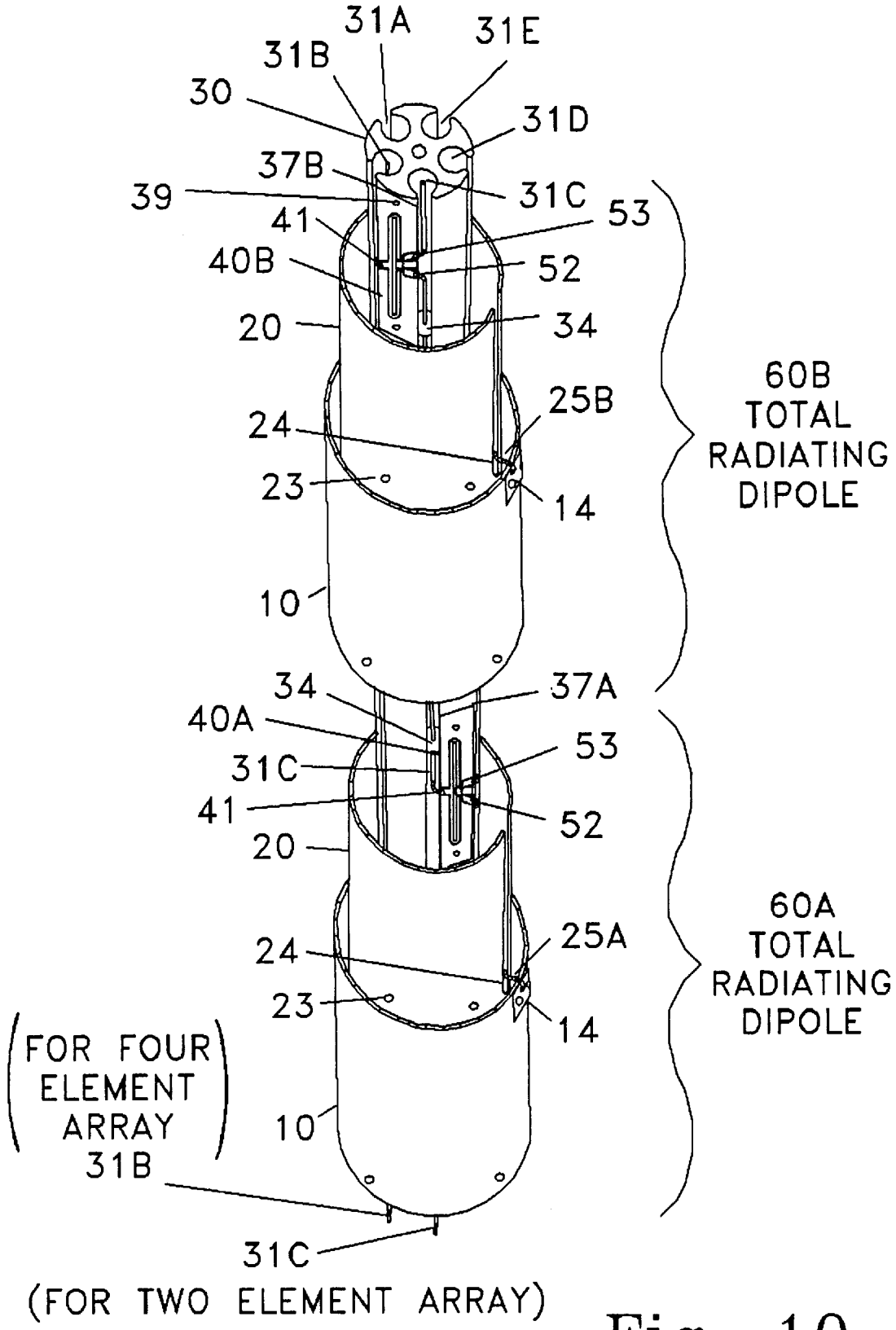
FIG. 10 is a detailed view of two of the coaxial dipole antenna elements forming the array of FIG. 12 illustrating the corporate feed structure.

A slot 24 is longitudinally aligned and positioned such that it begins directly under the edge of the radiating element 10 adjacent to the two bores 13 so the transmission line may be brought up through the slot 24 and affixed to the capacitor board secured via the bores 13 as illustrated in FIG. 10.

In the preferred method of assembly, the radiating cylinder 10 is snap fit to cylinder 20 by standoffs 12 which have a reduced section on either end to cooperate with bores 11 and 21. Standoffs/mounting studs 23 are snap fit into the bores 22 so that they radiate toward the center of cylinder 20. This subassembly comprised of cylinders 10 and 20 and the standoff/mounting studs 12 is then mechanically secured via an aluminum dip braze operation. The cylinder subassembly is then heliarc welded onto the conductive mast 30 via standoffs 23. This assembly procedure is used to create a coaxial dipole antenna without the use of conventional fasteners, thus eliminating mechanical joints of like or dissimilar metals where passive intermodulation products can be generated due to the electrical non-linearity's of the joints.

Figure 7:
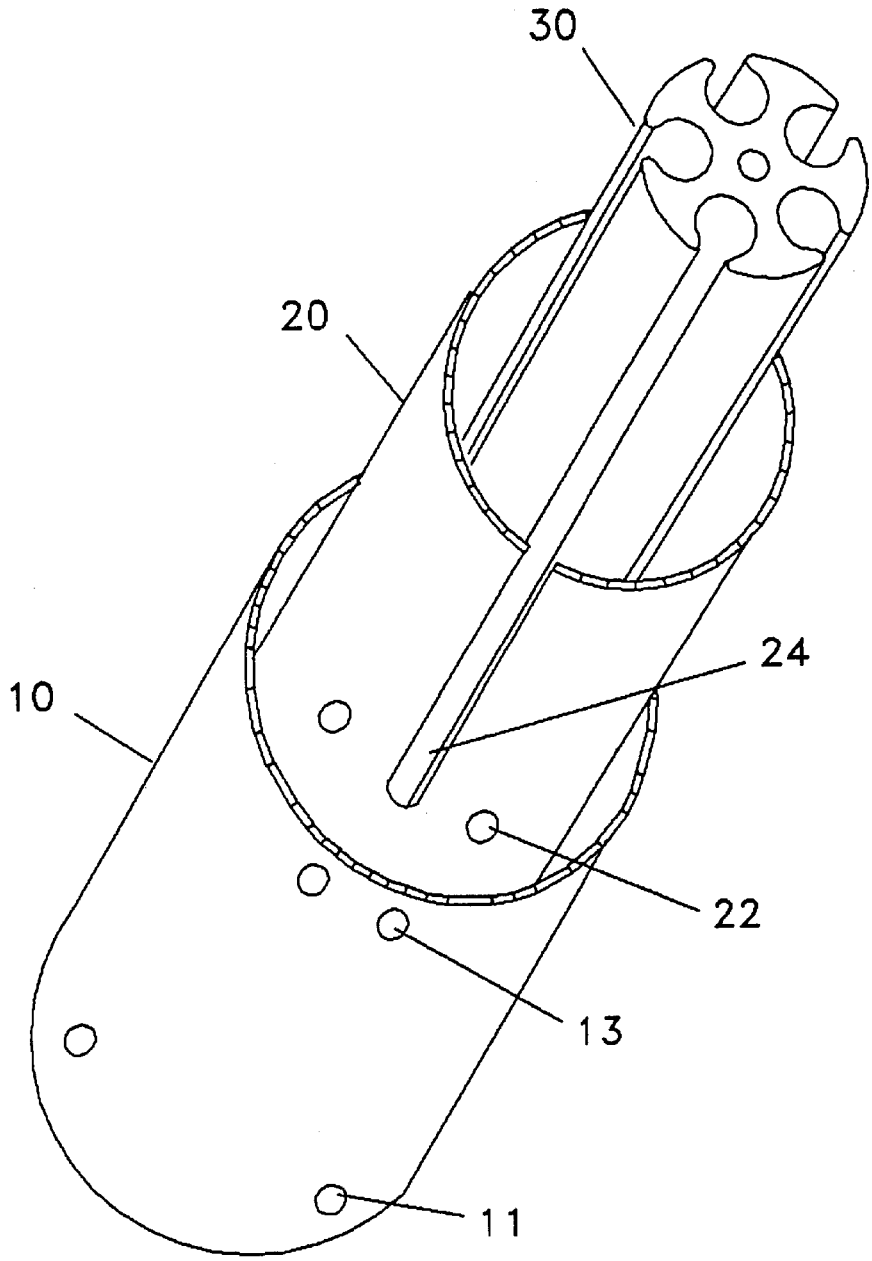
FIG. 7 is a perspective view of the coaxial dipole antenna components of FIG. 6 in their assembled form.

FIG. 7 illustrates the coaxial dipole antenna in its assembled form after dip brazing and heliarc welding. The length of the radiating cylinder 20 is electrically about one-half wavelength at the center frequency of the 806 to 960 Mhz band. The electrical length of the shorter outer cylinder, which is the driven element 10, is about one-quarter wavelength The longer radiating cylinder 20 is grounded at its midpoint to the electrically integral antenna mast 30 by metal standoff/mounting studs 23 as shown in FIG. 6 by dashed lines. This creates two coaxial transmission line quarter-wave sections which look like quarter-wave shorted lines at either end. Therefore, the driven element 10, the shorter outer cylinder, forms a coaxial center fed dipole with the exposed quarterwave of cylinder 20, the impedance at the midpoint of the assembly, where the girdle of metal standoff/mounting studs 23 are located, approximates a center fed dipole. The two ends of cylinder 20, in conjunction with the mast, look like open circuit sections of coaxial transmission line, and minimize the coupling of the dipole resonance currents to the mast support structure. The lengths of cylinders 10 and 20 can be adjusted to set the self resonant frequency of the coaxial dipole antenna.

Figure 8:
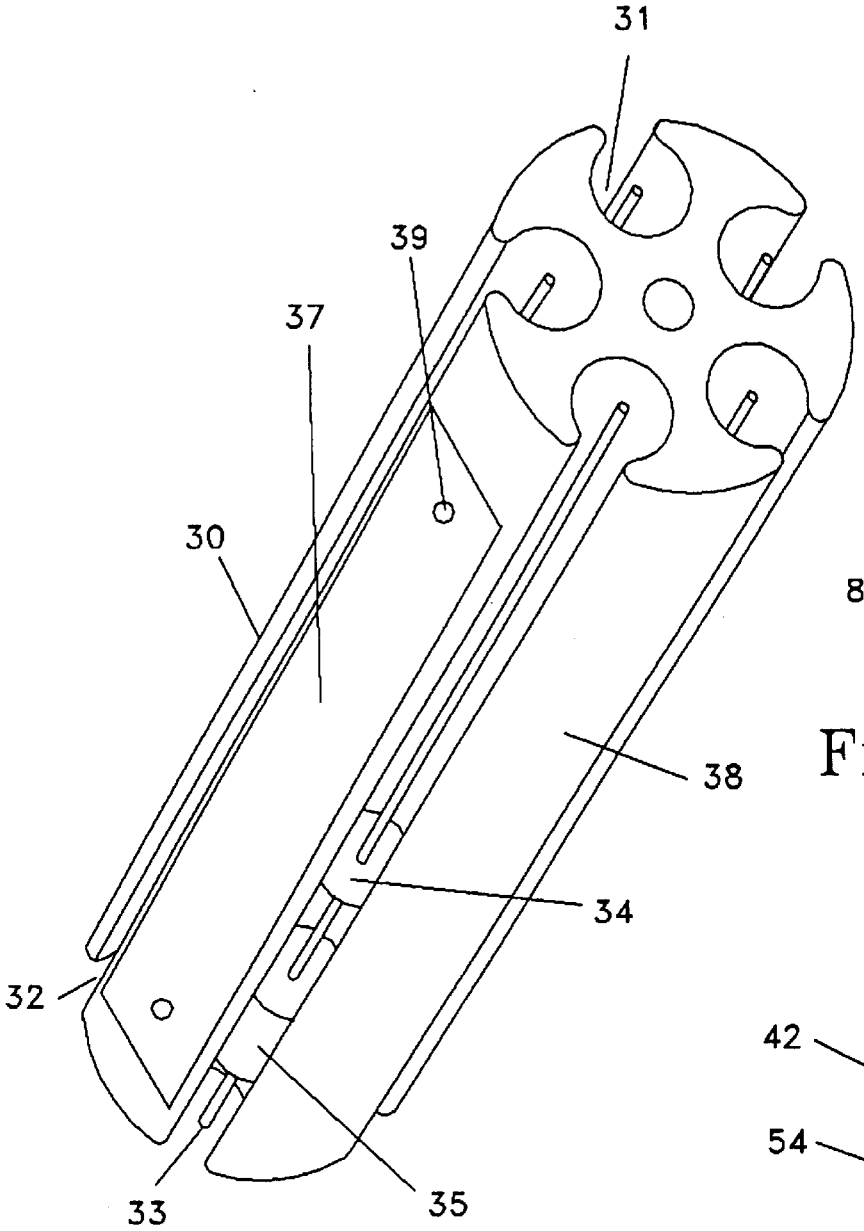
FIG. 8 is a perspective view of a section of the extruded antenna mast which provides support and is electrically integral to the coaxial dipole antenna elements of the present invention.

FIG. 8 illustrates a section of the antenna mast used to support the coaxial dipole antenna elements of the invention, and which is electrically integral to the coaxial choke structure, which electrically isolates the coaxial dipole antenna from the mast. The mast 30 is preferably an aluminum extrusion but it may be an extrusion of any desired material having an electrically conductive surface, and suited to joining processes/techniques without mechanical joints and junctions of dissimilar or similar metals. A plurality of bores 31 are equally spaced around the perimeter and include longitudinal slots 32 which are provided to simplify assembly of the conductors 33 and insulating spacers 34 which hold the conductors centrally in their respective bores creating coaxial transmission lines with the conductive superstructure of the mast functioning as the outer conductor for each coaxial transmission line assembly.

Non-conductive loading means such as dielectric sleeve 35 may be used to alter the electrical transmission phase characteristics of each coaxial transmission line to tailor the radiation pattern of the antenna.

The embodiment illustrated incorporates five transmission line cavities 31, but any number may be provided to meet the demands of a user. The cavities are slotted, 32, creating parallel arcuate surfaces 38 running the length of the mast. The arcuate surfaces are machined at selective locations to provide flat mounting pads 37 for power dividers used to create a corporate feed structure for an antenna array.

Figure 12:
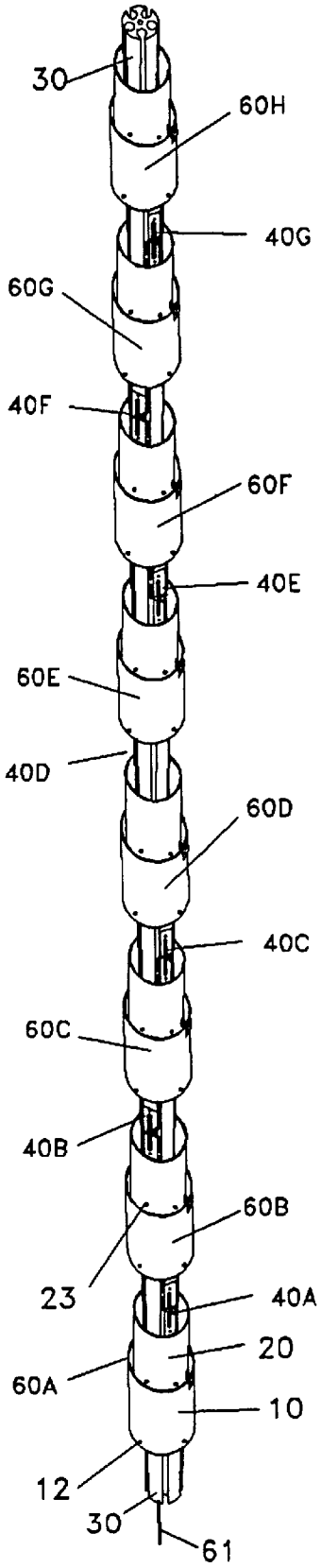
FIG. 12 is an eight-element array created by an assembly of coaxial dipole antenna elements on an extrusion such as partially illustrated by FIG. 8 using the power dividers illustrated by FIG. 9 to complete the corporate coaxial feed structure.

The section of an exemplary antenna mast illustrated in FIG. 8 is an extrusion incorporating five bores equally spaced around the periphery. This configuration has the capability of supporting a single radiating element as in FIG. 7 or an array of up to 16 radiating elements. A preferred form of the invention embodies an eight radiating element array as illustrated in FIG. 12. Power dividers are required to create an antenna array.

Through out the discussions of various embodiments that follow, the use of the terms output and input for signal transmission connections are presented as if the antenna is used for transmission only. This is a state assumed for simplification of the explanation. In reality the various corporate feed structures operate in a transceive environment and, therefore, "output" and "input" are interchangeable to provide fan out and fan in signal manipulation as required.

Figure 9B:
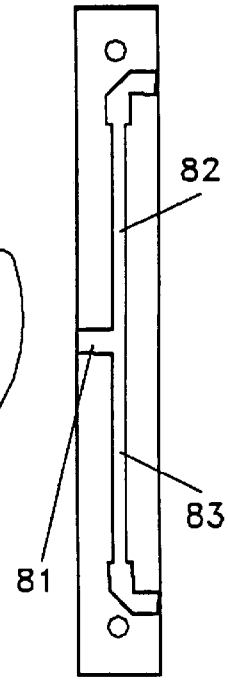
FIG. 9B is a detailed view of an alternate power divider used to combine a plurality of antenna elements into an array.
Figure 9A:
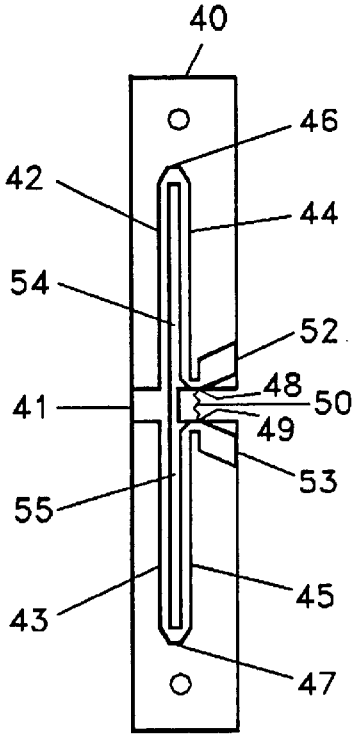
FIG. 9A is a detailed view of a preferred power divider used to combine a plurality of antenna elements into an array.

FIG. 9 illustrates a preferred signal splitter, a binary 3 dB power divider with a compact geometry designed to be used with the transmission assembly/mast illustrated by FIG. 8 to create a linear array antenna of the coaxial dipole elements of the present invention.

In a preferred embodiment of the power divider, the substrate 40 is an ARLON GT-250 Teflon loaded substrate supporting a power divider coupler with input transmission line 41, gap resistor 50 and coupled transmission line sections 42, 44, and 46 and 43, 45, and 47, and output transmission lines 52 and 53.

The input transmission line 41 is a 50 Ohm line terminated in a tee-connection to a pair of transmission line sections 42 and 43 which are coupled to transmission line sections 44 and 45 to create transmission phase quarter-wave length transformers 54 and 55. The ends of the coupled transmission line sections are shorted, 46 and 47, to provide a shorted coupled transmission line section with the characteristic impedance necessary for the impedance transformation from 50 to 100 Ohms required in a single section Wilkenson hybrid design. The shorted coupled transmission line section maintains a 90 degree transmission phase shift over a bandwidth equal to that of a standard Wilkenson coupler. The output ends 48 and 49 of the coupled transmission line sections form a gap in which a 100 Ohm resistor 50 is connected between the inputs to the 50 Ohm output transmission lines 52 and 53. The even mode and odd mode impedances, and, therefore, the characteristic impedance, and the electrical length of the coupled transmission line sections 42 and 43 and 44 and 45 may be varied by changing the spacing between coupled transmission lines, the width of the transmission lines, the width of the coupled transmission lines, and the physical length of the coupled transmission line sections. The bandwidth is a function of the coupled transmission line sections forming the impedance transformers 54 and 55. The power divider center frequency is a function of the length of the coupled transmission line sections 54 and 55.

FIG. 10 illustrates a two element antenna array combining a pair of coaxial dipole antennas 60A and 60B. Each antenna element is comprised of a quarter wavelength radiating cylinder 10A or 10B and a quarter wavelength radiating portion of cylinder 20A or 20B as described and illustrated by FIGS. 6 and 7. The conductive mast/multipath coaxial transmission means 30 includes a pair of machined surfaces 37A and 37B which are dimensioned to receive power dividers 40A and 40B. The conductive mast/multipath coaxial transmission means and power dividers are illustrated in FIGS. 8 and 9 and discussed in more detail in co-pending patent applications for "Signal Transmission Antenna Mast", filed concurrently herewith, and Ser. No. 08/831,923 filed Apr. 2, 1997 for "Power Divider Directional Coupler" both of which are incorporated herein by reference.

FIG. 10 combines two coaxial dipole antennas of the present invention where the center to center spacing of the dipoles and length of a multipath coaxial transmission line assembly/antenna mast 30 such as illustrated by FIG. 8 has been selected based on linear antenna array theory. The compact geometry power dividers such as illustrated by FIG. 9 can be mounted on, and interconnected by transmission lines mounted within the bores of the multipath coaxial transmission line assembly/antenna mast 30 illustrated by FIG. 8. Thus, two coaxial dipole antennas have been combined to create a two element antenna array which can be the sub-unit of an even larger array. Antenna radiators 60A and 60B are each identical and or similar to the coaxial dipole antenna assembly illustrated by FIG. 7. However, the invention contemplates the use of any acceptable means and signal splitters to create a two element antenna array which may be used as part of an even larger array.

In the preferred embodiment, power is transmitted to the coaxial dipole elements via a coaxial transmission line (as illustrated by FIG. 8 bores) comprised of a 0.1875 inch diameter rod 33 which is positioned centrally within a bore 31 of the mast 30 by a plurality of insulating spacers 34 and 35 to create the coaxial transmission path 31C. The spacers 34 and 35 are located in sections of rod 33 purposely reduced in diameter to maintain the 50 Ohm coaxial transmission line impedance. The coaxial transmission line input path to the power divider 40B and two coaxial dipole element array illustrated by FIG. 10 is in bore 31B of the mast 30. The terminating end of this coaxial transmission means 31B is the input 41 of power divider 40B which is secured to a machined surface 37B of the antenna mast 30 by a pair of stainless steel bolts threaded into tapped holes 39 of the mast 30. The two outputs of the power divider 40B, 53 and 52, are each connected to a 0.1875 inch diameter rod with spacers, where 52 is connected to power divider 40A at location 41 by a 0.1875 inch diameter rod with spacers in bore 31C. The outputs 52 and 53 of power divider 40A are connected to 0.1875 inch diameter rods with spacers in bore 31D. The terminating ends of the rods in bore 31D are connected to axial rods 25A and 25B. One rod, 25A, connected via 0.1875 inch diameter rod with spacers to output 52 of power divider 40A, creates a coaxial transmission path to antenna element 60A where it passes through slot 24 of the inner cylinder and is electrically connected to the capacitor board 14. The rod connected to the output 53 of the power divider 40A travels down bore 31D to a point opposite slot 24 of antenna 60B. At this point it is connected to an axial transmission line to pass through slot 24 to be connected to the capacitor board 14 of that antenna element. Thus, a two element antenna array is completed.

FIG. 10 illustrates a second power divider 40B which is fed by coaxial transmission means using the 31B bore of the mast 30 as an input means and the 31C bore as the output means. Thus one output of power divider 40B feeds power divider 40A to drive antenna elements 60A and 60B via the 31D bore. The other output of power divider 40B travels down the antenna mast 30 in the 31C bore to provide power to another pair of driven elements similar or identical to 60A and 60B using additional sections of the 31D bore of the antenna mast 30.

In the two element array of FIG. 10, a conductor and bore form a coaxial transmission path 31C which is terminated at the input 41 of power divider 40A. For a two element array, power divider 40A is fed directly from the antenna input via coaxial transmission path 31C. If the array of FIG. 10 is the lower segment of a larger array, output 52 of power divider 40B is the origination of the input to power divider 40A via coaxial transmission path 31C and a similar two element array is fed by a mirror image of coaxial transmission path 31C originating at output 53 of power divider 40B. In this case power divider 40B is driven by coaxial feed 31B which originates at the input to the antenna for a four element array. If a larger array of eight or sixteen elements is desired, power divider 40B is driven by another power divider such as 40D of FIG. 11 which is hidden behind the mast 30 in FIG. 12.

A preferred form of the invention is an eight coaxial dipole array comprised of four of the two coaxial dipole arrays of FIG. 10. Coaxial dipoles 60A and 60B constitute the lower two coaxial dipoles of the eight element array with three additional coaxial dipole pairs springing from the input via power dividers. The completed eight coaxial dipole array is schematically illustrated by FIG. 11 and structurally presented in FIG. 12.

The bottom most elements of the array, coaxial dipole antennas 60A and 60B, correspond to like numbered devices illustrated by FIG. 10. Two driven elements 60C and 60D are electrically connected in a mirror image to elements 60A and 60B creating a four coaxial dipole array by driving the lower half from the lower output of power divider 40B.

The upper half of the eight coaxial dipole array is a mirror image of the lower four coaxial dipole array driven by the lower output of power divider 40D. It is comprised of coaxial dipole antenna elements 60E, F, G, and H, identical in arrangement to coaxial dipoles 60A–D except the feed to coaxial dipoles 60E–H ascends from the output of power divider 40D.

Figure 11:
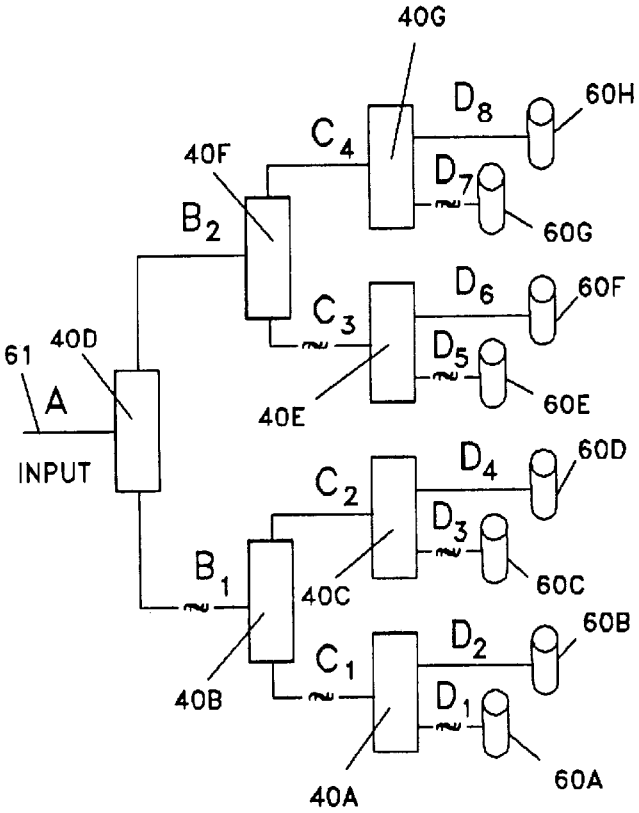
FIG. 11 is a schematic diagram of the feed circuit for the array illustrated in FIG. 12.

The arrangement of the eight coaxial dipole array may be best understood by considering the array of FIG. 12 in light of the details of two elements of the array presented by FIG. 10 combined with the schematic diagram of FIG. 11. Note in the section of the mast in FIG. 10, the five bores of the mast extrusion are identified as 31A–E. The letter suffixes identify the five bores of the mast extrusion which are selectively fitted with conductive rods to form coaxial transmission paths. In the schematic diagram of FIG. 11, the five letters of the suffixes are used to identify the schematically represented bores used to create the coaxial transmission path network required to drive the array of FIG. 12. The subscript numbers appended to the bore identifying letters denote individual rods positioned in the bore. For instance bore C has four rods, $C_1$–$C_4$, forming separate transmission paths. The input to the array, 61, is comprised of a conductive rod with a suitable connector designed to meet the needs of the specific application. This conductor is centered in bore 31A by a plurality of insulating bushings 34. It is terminated at the output end by a solder connection to the input to power divider 40D. Power divider 40D is located on a machined surface in the center of the array between bores 31A and B. The two outputs of power divider 40D are thus aligned with bore 31B in the same fashion as illustrated in FIG. 10 for power divider 40B. A pair of conductive rods B1 and B2 are positioned within 31B to form coaxial transmission path inputs to power dividers 40B and 40F which are secured to machined surface 37B between bores 31B and C as illustrated by FIG. 10.

The outputs of power dividers 40B and 40F utilize conductive rods centered in bore 31C to connect the outputs of those two power dividers to four additional power dividers 40A, 40C, 40E and 40G which are secured to machined surfaces between bores 31C and D, aligning their outputs with bore 31D. Each of these four terminal power dividers are provided with a pair of conductive rods positioned within bore 31D and dimensioned to provide a coaxial transmission path input to a coaxial dipole antenna as illustrated by FIG. 10. Thus bore 31A supports a single coaxial transmission path to the input power divider 40D; bore 31B supports two centrally positioned conductive rods forming coaxial transmission paths coupling 40B and 40F to the outputs of power divider 40G. In a like fashion, bore 31C is used to create four coaxial transmission paths serving the terminal power dividers of the array and bore 31D is provided with eight conductive rods to link the outputs of the terminal power dividers to the radiating coaxial dipole elements 60A through 60H.

Figure 13:
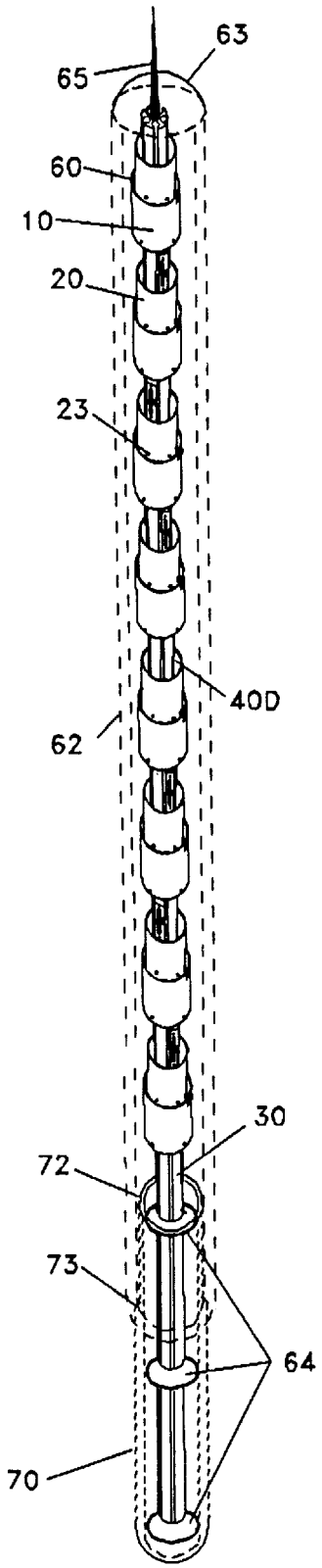
FIG. 13 is the perspective view of FIG. 14 with the mounting fixture illustrated in phantom.
Figure 14:
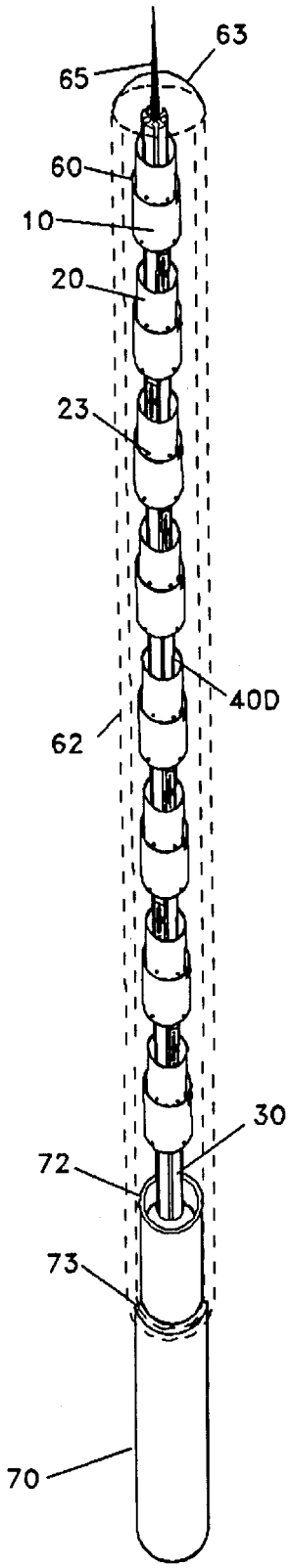
FIG. 14 is the perspective view of FIG. 15 with the radome illustrated in phantom.
Figure 15:
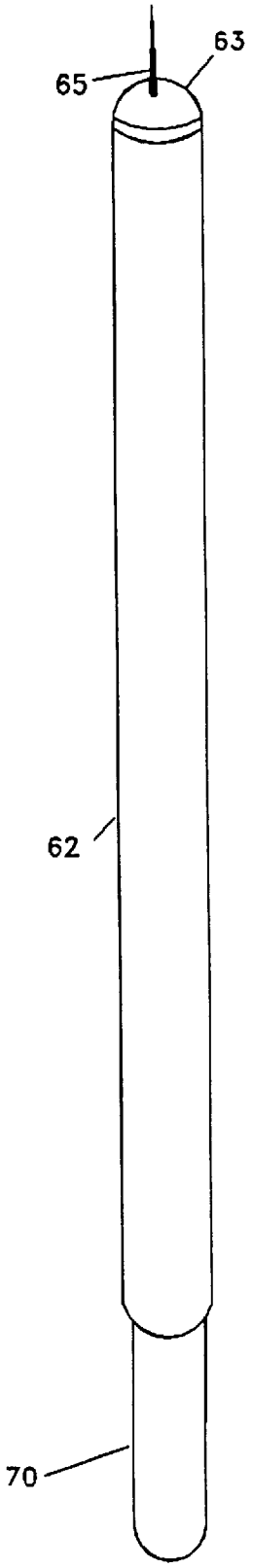
FIG. 15 is a perspective view of an operational assembly including antenna array, mounting fixture and radome.

The preferred and best mode of practicing the invention is an array of eight coaxial dipole antennas complete with mounting fixture, radome 62, cap 63 and lightning arrester spike 65 as illustrated in FIGS. 13, 14 and 15. It advantageously employs the prime features of the coaxial dipole antenna of the present invention, element 60, with parallel coaxial feeds built into the coaxial dipole antenna element support 30 which also serves as both a mounting platform for binary 3 db power dividers and as an antenna mast and ground. The support/antenna mast includes longitudinal bores for five coaxial center conductors that can be used to form the corporate feed structure, the characteristic impedance of which is a function of the center conductors, for up to 16 elements. The electrically integral support/mounting/mast, FIG. 8, is an aluminum extrusion with the five cylindrical openings slotted to the outer radius to allow ease of assembly of the corporate power divider feed structure required for the linear array. As previously explained, the standoff/mounting studs 23 of FIGS. 10 and 12 ground the center of the half-wave length center cylinder 20 of each coaxial dipole antenna element 60 to the mast extrusion 30 at five girdling locations. The length of the cylinder 60A or 60B of FIG. 10 is electrically one-half wavelength at the center frequency.

The spacer/mounting studs 12 shown in FIG. 6 are designed to snap into place to hold the two cylinder structures 10 and 20 which comprise a coaxial dipole antenna element 60 together in a self fixturing mode during the preferred method of assembly which is aluminum dip brazing. The sub-assembly 60 is then heliarc welded onto the standoff/mounting studs 23 which were previously secured to the electrically integral mast extrusion 30. Using dip brazing and heliarc welding eliminates mechanical joints held by fasteners and thereby avoids mechanical joints of like or dissimilar metals where passive intermodulation products can be generated due to the electrical nonlinearities of such joints. Preferably dip brazing is used where ever possible with heliarc welding used only when the components are too large to fit into available dip brazing tanks.

Prior to assembly, the physical length of the shorter outer cylinder 10 is machined so the electrical length at the operational center frequency is one-quarter wavelength. The longer cylinder 20 is machined to one-half wavelength and grounded to the mast 30 by standoff/mounting studs 23 at its midpoint. The two resulting quarter-wave sections electrically appear as quarter-wave lines shorted at the center. Therefore, the shorter outer cylinder 10 is the driven quarterwave from the midpoint of the inner cylinder 20. The lengths of the two cylinders are thereby adjusted to set the self resonant frequency of each coaxial dipole antenna 60.

In FIGS. 12 and 13 the mast 30 has a 50 Ohm line 61 suspended by Teflon spacers, 34 of FIGS. 8 and 10, in one of the slots in the center extrusion. A type N connector or any suitable connector can be mounted on one end of the mast to form the input port to the center power divider 40D as previously described and then fanned out as schematically illustrated in FIG. 11. The terminal ends of the corporate feed network are connected to the coaxial dipole antenna elements 60 via short transmission line extensions. The extensions are brought out through slots 24 in the inner cylinders 20 and soldered to the input to capacitor board 14 which is mounted on the outer surface of the driven element 10, creating a series circuit there with. The series capacitor board fine tunes the coaxial dipole antenna's impedance to resonance over the 806 to 960 Mhz band. The partially radiating center cylinder, grounded around its center line, acts as a quarter wave choke on either side to electrically isolate the entire radiating structure from the extrusion.

The coaxial transmission lines of the corporate network of the preferred embodiment uses 0.1875 inch diameter rod installed in the 0.431 inch diameter bores 31 to provide a 50 Ohm characteristic impedance for the feed lines. A short vertical transmission line connects the feed point of the outer short cylinder 10 to the 0.1875 inch diameter rod through slot 24 and through the series tuning capacitor board as previously described.

Following the concepts of the best mode of implementation of the invention, a second linear array can be placed as an extension on top of the 8 element array illustrated in FIGS. 12 and 13. Also, as another example, 3 four element arrays can be stacked axially or three different frequencies can be accommodated on a single mast extrusion. The center frequency of the arrays can be set by appropriately changing the physical spacing of the coaxial dipoles, the lengths of the coaxial dipole cylinders, the lengths of the transmission lines, the lengths of the Teflon loaded sections 35 to set progressive phase shift, the lengths of the coupled line sections in the power dividers of FIG. 9, and the length of the mast extrusion.

The best mode and preferred embodiment of FIG. 12 uses 3 dB couplers, such as the power dividers illustrated in FIG. 9. This results in each element having an equal amplitude excitation or excitation for a uniform array with theoretical side lobes 13.46 dB down from the main lobe. In the schematic, FIG. 11, of a generic eight-way power divider, each rectangle, 40A–G, represents a modified Wilkenson power divider incorporating a 100 Ohm 10 Watt isolation resistor as illustrated in FIG. 9. They are mounted on flat mounting pads machined into the surface of the arcuate exterior sections of the mast extrusion separating the bores. The center conductors of the interconnecting 50 Ohm lines are physically located in the slotted cylindrical bores of the mast extrusion. Teflon spacers hold the center conductors concentrically within the bores. The first two way power split occurs at power divider 40D physically located at the center of the eight coaxial dipole antenna elements which are spaced 10 inches center-to-center. The next level of power split fans out four ways using power dividers 40B and 40F. Power divider 40A, 40C 40E and 40G complete the eight-way split. Teflon loaded sections 35 are located on the left side of the array, i.e. in FIG. 12 the conductors coupling power divider 40A to coaxial dipole antenna 60A, 40C to 60C, 40E to 60E and 40G to 60G and the conductors coupling power divider 40B to power divider 40A, 40F to 40E and 40D to 40B; corresponding to the schematic lines $D_1$, $D_3$, $D_5$, $D_7$, $C_1$, $C_3$, and $B_1$ of FIG. 11. The antenna input conductor 61 is also on the left when viewing the physical location of the Teflon loaded center conductors in the array. The Teflon loading or progressive phase shift must be on the input connector end of conductor 61 if a downward beam tilt is desired. For 5 degrees of downward beam tilt, 22 degrees of progressive phase shift are required using 0.728 wavelength spacing between elements at 875 Mhz and coaxial dipole inter-element spacing of 10 inches center-to-center.

The progressive electrical phase shift between coaxial dipole elements of 22 degrees for a 5 degree beam tilt can be implemented either by displacement of the 3 dB coupler power dividers 40 along the interconnecting 50 Ohm lines or dielectric loading of the lines. Both approaches provide the desired beam tilt but the Teflon dielectric loading is preferable since the 3 dB power dividers physically remain fixed symmetrically in the linear array when mounted on the external surfaces of the mast. The diameter of the inner conductor is reduced from 0.1875 inches to 0.125 inches to maintain 50 Ohms characteristic impedance in the Teflon loaded sections. The 15 transmission lines of the eight element array occupy four of the five bores. The fifth bore may serve as the input line to a second array operating at a second frequency on the same mast extrusion.

If a broadside array is desired, no progressive phase shift or power divider displacement is incorporated into the corporate feed structure.

FIG. 13 presents the antenna array of FIG. 12 complete with radome 62 and mounting fixture 70 illustrated in phantom. The rings 64 are heliarc welded to the mast extrusion 30 and drilled and tapped to provide a means whereby the antenna mounting fixture 70 may be fastened to the base of the array.

The mounting fixture 70, best illustrated by FIGS. 13 and 14, is an aluminum tube, 3.5" in diameter with a 0.375" thick wall. It is turned down in diameter in the area of 72 to fit the inside diameter of the radome, which will then rest on the turned shoulder 73. The mounting fixture 70 is fastened to the tapped holes in the mounting rings 64 by flat head screws.

The radome is a fiberglass tube closed at the top by a Delrin end cap 63 through which an antenna mast lightning rod 65 protrudes. The lightning rod and end cap center and axially lock the radome in place, see FIG. 15.

The mounting fixture 70 will be parallel clamped to an existing pipe structure at the antenna mounting site.

The best mode of practicing the invention has thus far been detailed. Additional embodiments include different power dividers.

One such embodiment employs reactive tee power dividers such as illustrated by FIG. 9B. The corporate feed structure of one exemplary form of this embodiment employs a 50 ohm transmission line to the mechanical location of the split 81. The two arms, 82 and 83 to the output ports of the tee are one-quarter wavelength long at the center frequency. The characteristic impedance of lines 82 and 83 is 70.7 ohms to match the tee output ports back to 50 ohms. The quarter wavelength 70.7 ohm line sections 82 and 83 are changed to fit the center frequency as appropriate. If a multipath coaxial transmission line assembly/antenna mast is used, a 50 ohm line is run in the cylindrical bores to the points of the splits as previously described and illustrated by FIGS. 10, 11 and 12 and the impedance of the line through the windows 24 is maintained at 50 ohms.

An alternate configuration of the "tee" embodiment uses a one-quarter wavelength long 35.35 ohm line in front of the tee and 50 ohm lines after the split location.

In a further embodiment, broad side coupled thick bar or slab line versions of the parallel coupled directional coupler are combined with an extruded mast assembly by placing the couplers in the slots of the bores or in machined openings along the axis of the extrusion. This embodiment has 50 ohm ports for all couplings not at 3 db if the appropriate even and odd mode impedances are used in the coupled one-quarter wavelength long sections.

The exemplary embodiments of arrays have been based on uniform amplitude excitation linear arrays of even numbered radiating elements using binary 3 db power divider splits. However, additional embodiments may be implemented using the elements employed thus far but assembled into odd number of radiating element arrays. For instance a seven element shaped beam antenna array may be created by using splits other than 3 db. The design goal of a vertically shaped beam antenna will have non-uniform excitation and other excitation phase requirements for the radiating elements, dictating the use of different power divider values and incorporate transmission line structures for the basic elements employed herein.

While preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What is claimed is:

1. A coaxial dipole antenna, comprising:

an outer radiating cylinder one-quarter wavelength long at its operating center frequency;

an inner cylinder one halfwave length long at said operating center frequency, coaxially positioned within said one quarterwave length outer radiating cylinder, such that an end of said inner cylinder is aligned with an end of said outer radiating cylinder forming aligned ends;

a plurality of spacer/mounting studs dip brazed to said aligned ends of said outer radiating cylinder and said inner cylinder for positioning, mechanically and supportive joining and electrically connecting said aligned ends of said inner and outer cylinders;

an electrically integral conductive mast incorporating a longitudinal bore;

a slot in said inner cylinder through which an electrical conductor is connected to said outer radiating cylinder; and a plurality of standoff/mounting studs heliarc welded to said mast for supporting said coaxial dipole antenna and grounding the midpoint of said inner halfwave length long cylinder whereby said inner halfwave long cylinder is transformed electrically into two one quarterwave length long cylinders.

2. An antenna comprising:

a coaxial dipole antenna, including:

an outer radiating cylinder one quarterwave length long at its operating center frequency;

a quarterwave radiating/quarterwave non-radiating inner cylinder one halfwave length long at said operating center frequency coaxially positioned within said outer radiating cylinder with an end of said inner cylinder aligned with an end of said outer radiating cylinder;

means for electrically connecting said aligned ends of said outer radiating cylinder and non-radiating quarterwave of inner cylinder; and means for grounding the midpoint of said halfwave inner cylinder whereby said inner cylinder is transformed electrically into two one quarterwave length long cylinders.

3. An antenna as defined by claim 2, wherein said means for electrically connecting said aligned end of said outer radiating cylinder to said aligned end of said inner cylinder, comprising spacer/mounting studs dip brazed to said aligned ends of said outer and inner cylinders.

4. An antenna as defined by claim 2, comprising:

an electrically integral conductive mast incorporating a longitudinal bore; and an electrically conductive line coaxially positioned within said longitudinal bore for providing a coaxial signal transmission means for said coaxial dipole antenna.

5. An antenna as defined by claim 4, wherein said radiating quarterwave/non-radiating quarterwave inner cylinder includes a slot through which said coaxial signal transmission means is connected to said radiating outer cylinder.

6. An antenna as defined by claim 4, wherein said means for grounding the midpoint of said halfwave inner cylinder comprises said electrically integral conductive mast.

7. An antenna as defined by claim 6 wherein said means for grounding the midpoint of said halfwave inner cylinder further comprises standoff/mounting studs heliarc welded to said mast for supporting said coaxial dipole antenna.

8. An antenna as defined by claim 2, comprising:

an antenna array including a plurality of said coaxial dipole antennas.

9. An antenna as defined by claim 8, comprising;

an electrically integral conductive mast;

a plurality of longitudinal bores in said electrically integral conductive mast; and electrical conductors coaxially positioned within said longitudinal bores for providing coaxial signal transmission lines arranged as a corporate feed structure for said coaxial dipole antennas comprising said array.

10. An antenna as defined by claim 9, wherein said coaxial signal transmission corporate feed structure includes a terminal feed structure comprised of a final signal splitter connecting one of said coaxial signal transmission lines utilizing a first one of said bores to two of said coaxial signal transmission lines utilizing a common bore other than said first one of said bores for providing signal connections to first and second ones of said coaxial dipole antennas of said antenna array.

11. An antenna as defined by claim 10, wherein said coaxial signal transmission corporate feed structure includes a secondary feed structure comprised of a secondary signal splitter connecting one of said coaxial signal transmission lines utilizing a second one of said bores to two of said coaxial signal transmission lines utilizing said first bore for providing signal connections to first and second terminal feed structures.

12. An antenna as defined by claim 11, wherein said coaxial signal transmission corporate feed structure includes a primary feed structure comprised of a primary signal splitter connecting one of said coaxial signal transmission lines utilizing a third one of said bores to two of said coaxial signal transmission lines utilizing said second one of said bores for providing signal connections to first and second secondary feed structures.

13. An antenna as defined by claim 12, wherein at least one of said signal splitters is a power divider, comprising:

an input line; and a tee-connection for impedance matching said input line to first and second output lines.

14. An antenna as defined by claim 10, wherein said signal splitter is a power divider, comprising:

an input line; and a tee-connection including a first and a second line terminating said input line.

15. An antenna as defined by claim 8, including a corporate feed structure for said coaxial dipole antennas comprising said array.

16. An antenna as defined by claim 15, wherein said corporate feed structure includes a terminal feed structure comprised of a final signal splitter connecting a secondary signal transmission line to two final signal transmission lines for providing signal connections to first and second ones of said coaxial dipole antennas of said antenna array.

17. An antenna as defined by claim 16, wherein said corporate feed structure includes a secondary feed structure comprised of a secondary signal splitter connecting a primary signal transmission line to two of said secondary signal transmission lines for providing signal connections to first and second terminal feed structures.

18. An antenna as defined by claim 17, wherein said corporate feed structure includes a primary feed structure comprised of a primary signal splitter connecting an input signal transmission line to two of said primary signal transmission lines for providing signal connections to first and second secondary feed structures.

19. An antenna as defined by claim 18, wherein at least one of said signal splitters is a power divider, comprising:

an input line;

a tee-connection for coupling said input line to first and second input impedance matched output lines.

20. An antenna as defined by claim 16, wherein said final signal splitter is a power divider, comprising:

an input line;

a tee-connection joining said input line to a first coupling line and a second coupling line;

a first input impedance matched output line connected to said first coupling line; anda second input impedance matched output line connected to said second coupling line.

* * * * *